United States Patent [19]

Couper

[11] Patent Number: 4,940,224

[45] Date of Patent: Jul. 10, 1990

[54] MULTIPLE DOCUMENT DETECTOR AND SEPARATOR

[75] Inventor: John Couper, West Lothian, Scotland

[73] Assignee: Unisys Corporation, Blue Bell, Pa.

[21] Appl. No.: 284,276

[22] Filed: Dec. 14, 1988

[30] Foreign Application Priority Data

Mar. 23, 1988 [GB] United Kingdom ..... 8806958

[51] Int. Cl.[5] ..... B65H 7/06

[52] U.S. Cl. ..... 271/263; 271/121

[58] Field of Search ..... 271/263, 121, 122, 125, 271/116

[56] References Cited

U.S. PATENT DOCUMENTS

| | | | |
|---|---|---|---|
| 4,032,135 | 6/1977 | Ruenzi | 271/116 |
| 4,203,586 | 5/1980 | Houer | 271/263 X |
| 4,420,151 | 12/1983 | Kobayashi | 271/263 |
| 4,522,385 | 6/1985 | Stefansson | 271/116 X |
| 4,753,433 | 6/1988 | Rodi | 271/263 |
| 4,761,002 | 8/1988 | Reed | 271/263 X |
| 4,763,162 | 8/1988 | Yagasaki | 271/263 X |

FOREIGN PATENT DOCUMENTS

| | | | |
|---|---|---|---|
| 78936 | 5/1983 | Japan | 271/263 |

*Primary Examiner*—Richard A. Schacher

*Attorney, Agent, or Firm*—Mark T. Starr; Robert S. Bramson

[57] ABSTRACT

A multiple document detector set having a driven wheel and an opposed idler wheel for gripping documents in a pinch created there-between. The idler wheel (44) is provided with a slipping clutch (62) for creating a rotation opposing torque. The idler wheel (44) and the driven wheel (42) each have a coefficient of friction against documents greater than the coefficient of friction of documents against one another. When multiple documents are introduced into the nip (46) one document (32) is held by the idler wheel (44) and the other document (34) is driven by the driven wheel (42). A monitor (18) detects whether or not the driven wheel (42) has the same periphral velocity as the idler wheel (44) and signals the presence of multiple documents if the peripheral velocities are not the same. The monitor (18) signals completion of separation of multiple documents when the peripheral velocites once again become the same. Tandom provision of multiple document detectors sets (10) along the length of a track (12) insures that large numbers of documents (32,34) simultaneously presented in the track (12) can be separated. The multiple document detector sets (10) are provided as the prime or even sole motive force for documents (34,32) along the track (12).

12 Claims, 5 Drawing Sheets

MULTIPLE DOCUMENT DETECTOR AND SEPARATOR

BACKGROUND OF THE INVENTION

The present invention relates to an apparatus for detecting simultaneous presentation of multiple documents. It particularly relates to such an apparatus used to detect the presence and passage of multiple documents along a track. The invention is hereinafter described with reference to its use in a document encoding machine wherein documents are passed along a track from an input pocket to one or more output stacks. It is to be understood that the present invention is not limited by this example to such particular use.

SUMMARY OF THE INVENTION

In a document encoding machine cheques or other documents are extracted one-by-one from an input pocket or stack to be sent along a track along which various reading or printing operations are executed upon the document. The processed document is then deposited in one or more output pockets. Typically the documents are sorted by type into the output pockets.

The extraction of documents, one-by-one from an input pocket, is not a perfect process. From time to time two or more documents can simultaneously be extracted from the input stack and sent along the track. When this happens, either the unwanted document passes undetected and unprocessed along the track, or else malfunction of the various document processing stages along the track occurs.

In the prior art it is known to shine a beam of light across the path of an oncoming document. If more than one downward step change in intensity of transmitted light across the document occurs, it is known that multiple documents have been presented to the track. It is then the normal procedure to stop the track and remove the multiple documents to be replaced in the input stack or pocket for reprocessing. If the documents have their leading edges aligned there is no way that multiple downward steps in transmitted light intensity can be detected since the multiple steps all occur at the same instant. The present invention seeks to overcome these difficulties.

The present invention consists in an apparatus for detecting simultaneous presentation of multiple documents having a multiple document detector set comprising: a driven member for imparting motive force to a document; an idler member, opposed to said driven member and co-operative with said driven member to grip documents there-between; and a velocity monitor; said driven member having a coefficient of friction against documents greater than the coefficient of friction of documents against each other; said idler member having a coefficient of friction against documents greater than the coefficient of friction of documents against each other; said idler member providing a document movement opposing force sufficient, when multiple documents are present between said idler member and said driven member, to cause sliding between documents; and said monitor monitoring relative peripheral velocity between said driven member and said idler member and providing a first output indicative of presentation of multiple documents when there is a difference between said relative peripheral velocities.

In the prior art it is known to stop the document track for extraction of a document for reprocessing, the present invention seeks to provide continuous document movement without stopping in an apparatus wherein a driven wheel is operative to continue to provide the motive force after the provision of the first output by the velocity sensor to cause separation between multiple presented documents. The present invention further seeks to provide improvement over the prior art by arranging that the velocity monitor, having once provided the first output indicative of the presence of multiple documents, is thereafter operative to provide a second output indicative of completion of document separation when the peripheral velocity of the driven wheel is equal to the peripheral velocity of the idler wheel.

The present invention further seeks to provide improvement over the prior art by providing a positive document separation facility along the track. The apparatus is provided with further document moving means operative to grasp a document from between the driven wheel and the idler wheel and to move the received document with a linear velocity greater than the peripheral velocity of the driven wheel. It is also a feature of the present invention that the further document moving means is inhibited from moving a document from between the driven wheel and the idler wheel with increased velocity until the velocity sensor provides a second output indicative of completion of document separation. Preferably, the present invention provides that the second document moving means comprises a second multiple document detector set. In the preferred embodiment the second multiple document detector set can select either a high peripheral velocity for the idler wheel and for the driven wheel or can select a standard peripheral velocity for the idler wheel and for the driven wheel equal to the peripheral velocity of the idler wheel and the driven wheel in the first or feeder multiple document detector set. When the first multiple document detector set indicates that it has detected multiple documents, the peripheral velocity of the driven wheel in the second multiple document detector set is set to the standard value equal to the peripheral velocity of the driven wheel in the first multiple document detector set. Once the first multiple document detector set indicates that it has completed separation of documents, this fact is signalled to the second multiple document detector set which sets the motor speed to drive the now separated document away from following documents with a higher velocity. In this way multiple documents are separated one from another along the track.

In one preferred embodiment of the invention the driven wheel is driven by a stepping motor receiving its stepping instructions from a monitor. The idler wheel has an idler wheel shaft encoder. The monitor compares the output of the shaft encoder with the number of steps administered by the stepping motor and provides a first output indicative of multiple documents if the peripheral velocities are not equal, and provides the second output, indicative of completion of separation of documents, if the peripheral velocities of the idler wheel and the driven wheel once again become equal. In another preferred embodiment of the invention, the motor is an ordinary motor which is speed regulated, and the driven wheel has a shaft upon which a driven wheel shaft encoder is mounted. The outputs from the driven wheel shaft encoder and the idler shaft encoder are compared by the monitor to determine whether a difference in peripheral velocity exists between the idler wheel and the driven wheel.

The present invention also provides that the monitor monitors the velocities of the driven wheel and of the idler wheel to determine whether or not a document is jammed in the track.

BRIEF DESCRIPTION OF THE DRAWINGS

The present invention is further explained, by way of example, by the following description taken in conjuction with the appended drawings in which.

DESCRIPTION OF THE PREFERRED EMBODIMENTS

Figure 1:
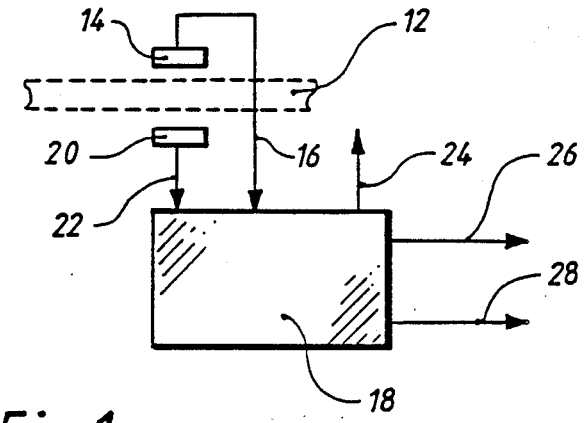
FIG. 1 shows a schematic block diagram of a multiple document detector set.

FIG. 1 shows a schematic diagram of a multiple document detector set 10. A document track 12 (as will hereinafter be described) has a driven wheel on one side and an enclosed idler wheel on the other. A driven wheel angular velocity transducer 14 provides a signal indicative of the angular velocity of the driven wheel, on output line 16, to a monitor 18. An idler wheel angular velocity transducer 20 provides input to the monitor 18 via an output line 22. The monitor in turn provides a motor drive output 24, a first signal output 26 indicative of multiple documents being present on the track, and a second signal output 28 indicative of multiple documents having been separated. These latter functions and these components will be clarified in the following description.

Figure 2:
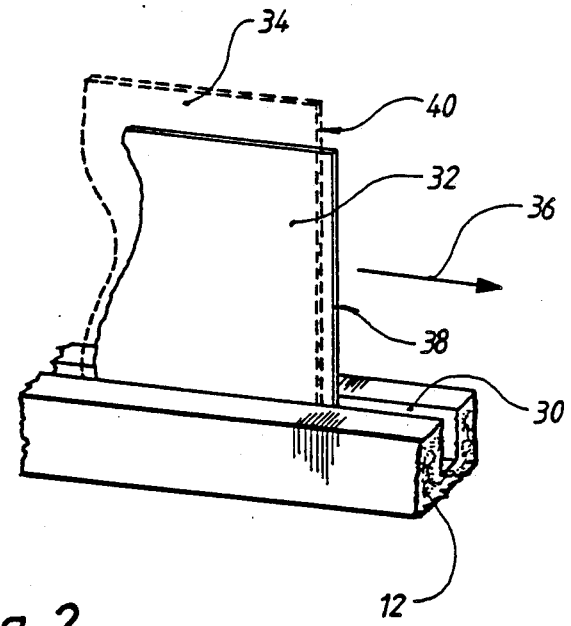
FIG. 2 is a projected view of a document moving along a document track with a second, multiple unwanted document shown in phantom outline.

FIG. 2 shows the document track and the manner in which multiple documents can move down the track.

The track 12 has a groove or slot 30 wherein documents 32, 34 can move as indicated by arrow 36. In FIG. 2 a first document 32 is shown in solid line while a second, undesired document 34, accompanying the first document 32 and which should have been separately fed into the track 12, is shown in phantom outline. Should the leading edge 38 of the wanted document 32 and the leading edge 40 of the unwanted document 34 be in alignment, it is impossible, using optical means looking for multiple steps of light transmission, to detect the presence of both documents. It is the object of the present invention to provide means whereby such wanted and unwanted documents can be detected. The invention further seeks, in a further embodiment, to provide means whereby the wanted document 32 and the unwanted document 34 can be separated to progress along the track 12 for individual processing.

Figure 3:
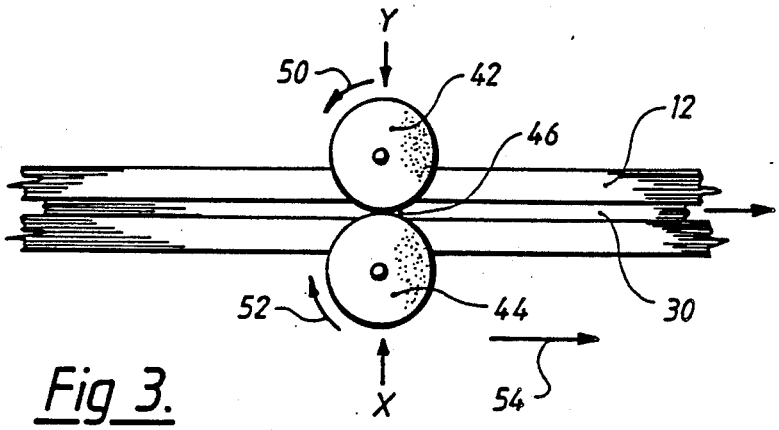
FIG. 3 is a plan view of a multiple document detection station.

Referring to FIG. 3, a driven wheel 42 is opposed by an idler wheel 44 to form a nip 46 over the groove 30 in the track 12. The driven wheel 42 is driven by a motor 48, FIG. 5 to rotate as indicated by arrow 50 which in turn, except when multiple documents 32, 34 are present, causes the idler wheel 44 to rotate as indicated by arrow 52. A document, held in the nip 46, is urged to move in the track 12 as indicated by arrow 54.

Figure 4:
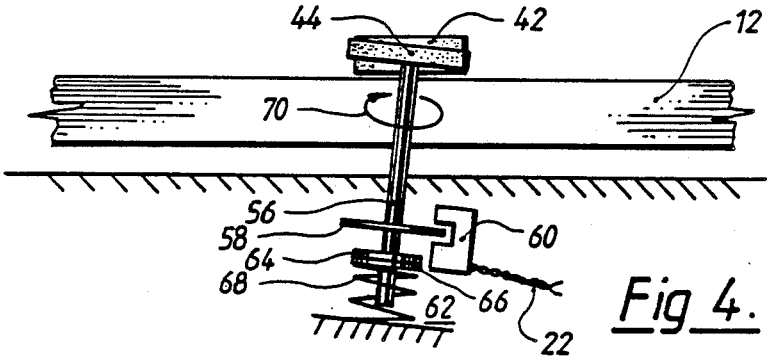
FIG. 4 is a side elevation of FIG. 3 looking in the direction of arrow X.

In FIG. 4, the idler wheel 44 is shown mounted on an angled shaft 56 upon which an optical disc 58 bearing successive light transmitting and opaque areas is interactive with an idler wheel photodetector 60. The idler wheel photodetector 60 and the idler wheel optical disc 58 together form the idler wheel angular velocity transducer 20 of FIG. 1.

The idler wheel shaft 56 has a slipping clutch 62 generally comprising a first plate 64 on the idler wheel shaft 56 and a fixed second plate 66, urged by a spring 68 against the first plate 64 to cause a predetermined rotation-opposing torque to be applied to the idler wheel shaft 56. As the driven wheel 42 rotates, the idler wheel shaft 56 rotates as indicated by arrow 70.

Figure 5:
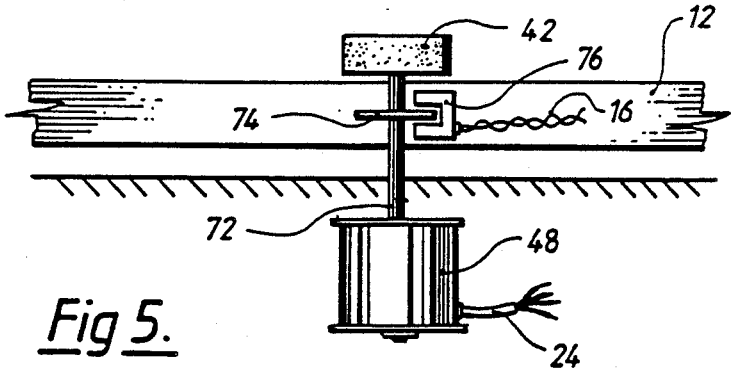
FIG. 5 is a side elevation of FIG. 3 looking in the direction of arrow Y.

In FIG. 5 the driven wheel 42 is shown mounted on a shaft 72 along with a driven optical disc 74 which, like the idler wheel optical disc 58, bears alternate circumferential light transmitting and opaque areas which are sensed by a photodetector 76.

As will hereinafter be described, if the motor 48 is a stepping motor, the driven wheel optical disc 74 and the driven wheel photodetector 76 can be omitted. The driven wheel optical disc 74 and the driven wheel photodetector 76 together form the driven wheel angular velocity transducer 14 of FIG. 1.

Figure 6:
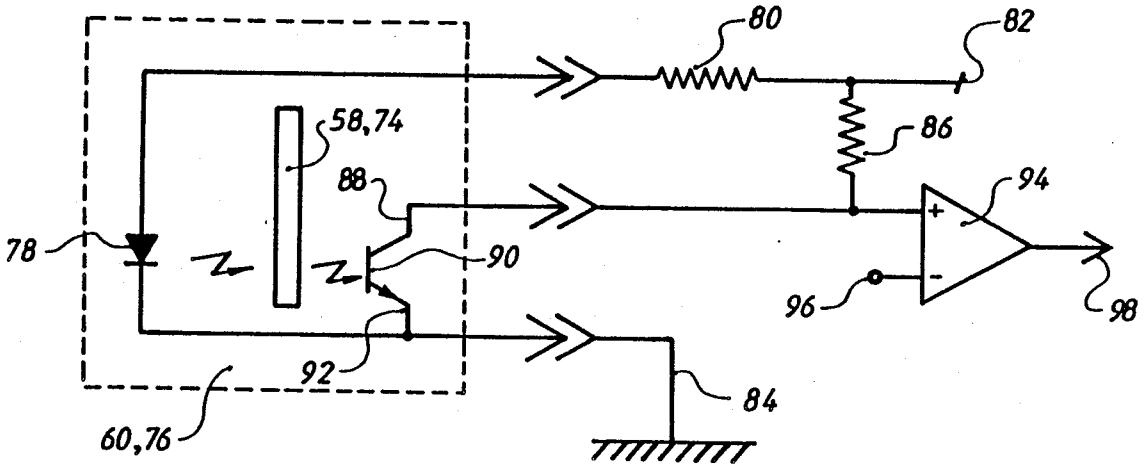
FIG. 6 is a representative circuit capable of use with a shaft encoder as illustrated in FIGS. 4 and 5.

Referring to FIG. 6 a light emitting diode 78 is connected via a first resistor 80 between a source of power 82 and ground 84. The light emitting diode 78 emits light which passes through the optical disc 58, 74. A second resistor 86 connects the collector 88 of the photo-transister 90 to the source of power 82 and the emitter 92 of the phototransistor 90 is connected to ground 84. As the optical disc 58, 74 rotates it intermittently blocks the light from the light emitting diode 78 to switch the phototransistor 90 between conducting and non-conducting states. The second resistor 86 develops the current change in the phototransistor 90 into a voltage which is applied as a first input to a voltage comparator 94. The second input of the voltage comparator 94 is provided from a reference voltage 96 and the comparator 94 provides output 98 which is logically indicative of whether or not the voltage on the collector 88 of the phototransistor 90 is larger or smaller than the reference voltage 96. It is generally to be understood that the first resistor 80, the second resistor 86 and the voltage comparator 94 will be provided within the monitor 18 of FIG. 1. As the idler wheel 42 or the driven wheel 44 rotates, the number of pulses at the output 98 of the comparator 94 in any unit time is proportional to the angular velocity of the driven wheel 42 and the angular velocity of the idler wheel 44. The angular velocities of the driven wheel 42 and the idler wheel 44 are in turn proportional to the linear peripheral velocities they posses in the nip 46. The monitor 18 counts the number of comparator 94 output pulses 98 over unit time intervals both from the idler wheel photodetector 60 and from the driven wheel photodetector 76 to determine whether or not the peripheral velocities of the driven wheel 42 and the idler wheel 44 are the same. If the output pulse rate in each instance falls within predetermined limits, either by comparison against some absolute value or by comparison against one another, the monitor 18 deems the peripheral velocities of the driven wheel 42 and the idler wheel 44 to be the same. If however, the peripheral velocities are not equal by more than a small predetermined amount, the monitor 18 determines that the peripheral velocites of the driven wheel 42 and of the idler wheel 44 are not the same.

It is to be understood that, while the figures show the driven wheel 42 and the idler wheel 44 to be of the same diameter, this need not be the case. The idler wheel optical disc 58 and the driven wheel optical disc 74 can provide different numbers of output pulses 98 for each revolution of their respective wheel 42, 44. In the preferred embodiment both wheels 42, 44 are of the same diameter and the respective optical discs 58, 74 give the same number of output pulses 98 for each revolution of their respective wheels 42, 44. The present invention also encompasses the situation where different numbers of output pulses 98 are received for each revolution of each wheel 42, 44. In this instance the monitor 18 compares the numbers of received pulses against an expected ratio, and should the ratio of the pulses received from the idler wheel photodetector 60 deviate by more than a predetermined amount in its ratio from the number of output pulses from the driven wheel photodetector 76, the monitor 18 determines that the driven wheel 42 and the idler wheel 44 do not possess the same peripheral velocity in the nip 46.

It is to be understood that the driven wheel angular velocity transducer 14 and the idler wheel angular velocity transducer 20 can be of other forms. For example, motor tachometers can be employed and their relative output voltages compared. It is only necessary that the driven wheel angular velocity transducer 14 and the idler wheel angular velocity transducer 20 be capable of providing a signal which can be monitored and assessed by the monitor 18.

In one embodiment of the invention, the driven wheel angular velocity transducer 14 is entirely omitted. Instead, the motor 48 is a stepper motor. A stepper motor executes an amount of rotation proportional to the number of angular steps it is commanded to execute. The monitor 18 provides step commands to the motor 48 on the motor drive output 24. The monitor 18, at the same time, monitors the output from the idler wheel angular velocity transducer 20. If any discrepancy is discovered by the monitor 18 between the expected output from the idler wheel angular velocity transducer 20 in light of the rate of steps applied to the motor 48 and the actual output of the idler wheel angular velocity transducer 20, the monitor 18 determines that the peripheral velocities of the driven wheel 42 and of the idler wheel 44 at the nip 46 are not the same.

It is a requirement of the present invention that the monitor 18 be capable of monitoring the peripheral velocities of the driven wheel 42 and of the idler wheel 44.

The driven wheel 42 is urged against the idler wheel 44 as generally indicated by arrows X, Y (FIG. 3). The material of the driven wheel 42 and the idler wheel 44 are chosen such that the driven wheel 42 and the idler wheel 44 each possess a coefficient friction against a document which is greater than the coefficient of friction of a document against another document. Suitable materials for the driven wheel 42 and the idler wheel 44 include neoprene, silicon rubber and other elastic polymers. It is a matter of choice depending upon the type of documents which are to be processed, to select suitable materials for the driven wheel 42 and the idler wheel 44.

Referring to FIG. 4, the idler wheel 44 is shown angled simply for any document 32, 34 passing along the track 12 to be urged down into the groove 30 as it traverses the nip 46 by the angled rotation of the idler wheel 44. The idler wheel 44 and the driven wheel 42 not only serve to detect multiple documents in the groove 30 of the track 12, but also serve to move documents 32, 34 along the track 12 and the present invention contemplates that plural multiple document detector sets can be provided along the track 12 as the prime or sole motive means for documents 32, 34.

Figure 7:
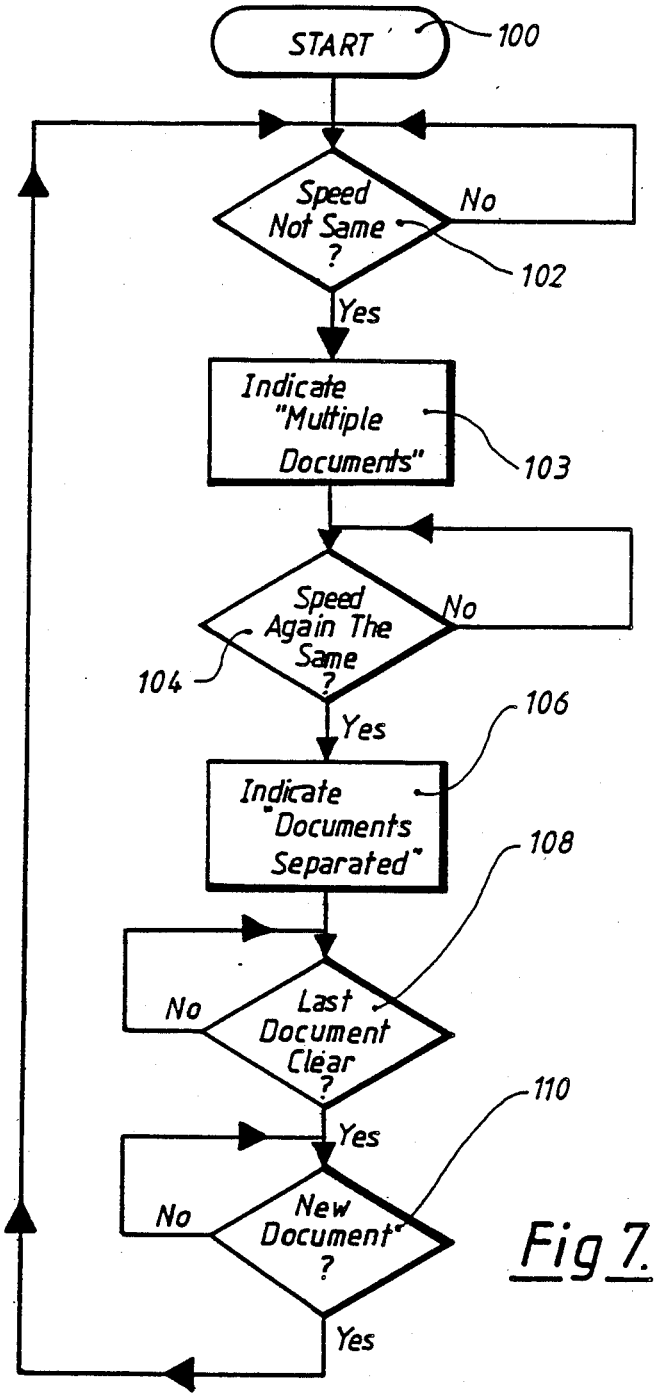
FIG. 7 is a flow chart representing the operation of the monitor of FIG. 1.

FIG. 7 is a flow chart illustrating the actions of the monitor 18 of FIG. 1. The routine is entered from a first start operation 100 when the document encoding equipment is switched on. Control is immediately passed to a first test 102. In the first test 102, as documents 32, 34 move along a track, the monitor 18 monitors the peripheral velocities of the driven wheel 42 and of the idler wheel 44 to see if they are the same. If the peripheral velocities of the idler wheel 44 and the driven wheel 42 are the same, control is returned by the first test 102 back to itself. If the peripheral velocity of the driven wheel 42 is not equal to the peripheral velocity of the idler wheel 44, control is passed to a first operation 103. The first operation 103 causes the monitor 18 provide the first output signal 26 indicative of multiple documents being present in the nip 46. The difference in peripheral velocity is caused by the predetermined torque, provided by the slipping clutch 62 on the idler wheel 44, causing the idler wheel 44 to grip the document 32 nearest thereto, that document sliding against the document next adjacent thereto. The driven wheel 42 continues to drive forward the document 34 nearest to the driven wheel 42, whereas the document 32 adjacent to the idler wheel 44 is retarded. When the two documents 32, 34 slide against one another, a difference appears in peripheral velocities between the driven wheel 42 and the idler wheel 44. The peripheral velocity difference persists so long as there are multiple documents in the nip 46. The multiple documents 32, 34 are separated one from another along the groove 30 by the driving action of the driven wheel 42 and the retarding action of the idler wheel 44 and the mutual slip between documents.

The first operation 103 passes control to a second test 104 which checks to see if the peripheral velocity of the driven wheel 42 has once again become equal to the peripheral velocity of the idler wheel 44. If the peripheral velocities are still unequal, the second test 104 returns to control to itself. If the peripheral velocities have again become equal, the second test 104 passes control to a second operation 106. The second operation 106 causes the controller 18 to provide the second output signal 28 indicative of separation of documents having been completed. When the driven wheel 42 has caused the document 34 adjacent thereto to have slid past the document 32 adjacent to the retarded idler wheel 44, only the document 32 which has so far been adjacent to the idler wheel 44 will remain within the nip 46. When only one document 32 remains in the nip 46 the driven wheel 42 entrains the idler wheel 44 through the document 32 such that their peripheral velocities once more become equal. This is indicative, as shown in the second operation 106, of a completion of the process of document separation. Had there been more than two documents in the nip 46, equal peripheral velocity between the driven wheel 42 and the idler wheel 44 would not have been achieved until just one document 32 remained in the nip 46.

The second operation 106 passes control to a third test 108 which tests to see if the last document 32 has exited from the nip 46. This can be done by any means known in the art such as photo-optic detection of the presence of a document in the proximity of the nip 46. If the last document 32 has not cleared the nip 46 the third test 108 returns control to itself. If the last document 32 has cleared the nip 46 the third test 108 passes control to a fourth test 110 which, using means known in the art, as indicated for the third test 108, checks to see if a new document has entered the nip 46. If photo-optic or other means indicate that a new document has entered the nip 46, the fourth test 110 passes control back to the first test 102. If not, the fourth test 110 passes control back to itself.

It is seen that the mechanism of FIGS. 1, 3, 4, 5 and 7 acts not only to detect multiple documents in the nip 46 but also acts to separate those documents 32, 34 and send them along the groove 30 in the track 12 one-by-one.

Figure 8:
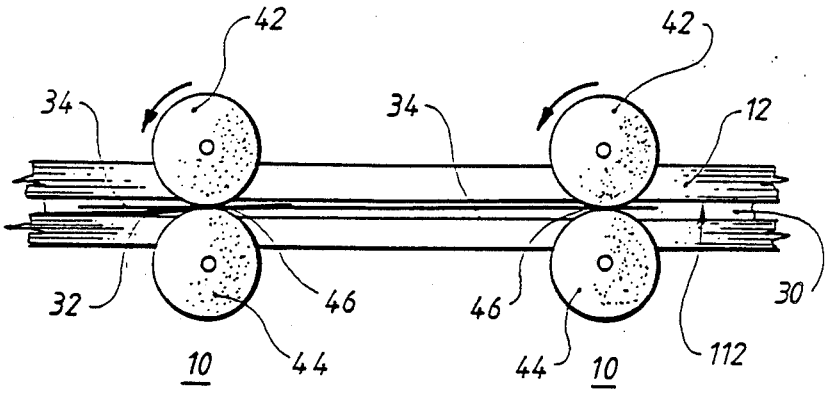
FIG. 8 is a plan view of an embodiment of the present invention wherein two document detector sets are provided in tandem.

A problem exists in that there may not be adequate linear separation between multiple documents which have been presented to the nip 46, which have been separated by the nip 46, and, having been separated, which are sent along the track 12 for further processing. FIG. 8 shows a plan view of one means according to the present invention whereby this difficulty may be overcome.

A first multiple document detector set 10 acts as a feeder set to a second multiple document detector set 10'. The separation along the track 12 between the first document detector set 10 and the second multiple document detector set 10' is less than the length of a document 32, 34. As multiple documents 32, 34 in the nip 46 of the first multiple document detector set 10 are separated, the leading edge 112 of the document 34 adjacent to the driven wheel 42 in the first multiple document detector set 10 passes into the nip 46' between the driven wheel 42' and the idler wheel 44' of the second multiple document detector set 10'.

Figure 9:
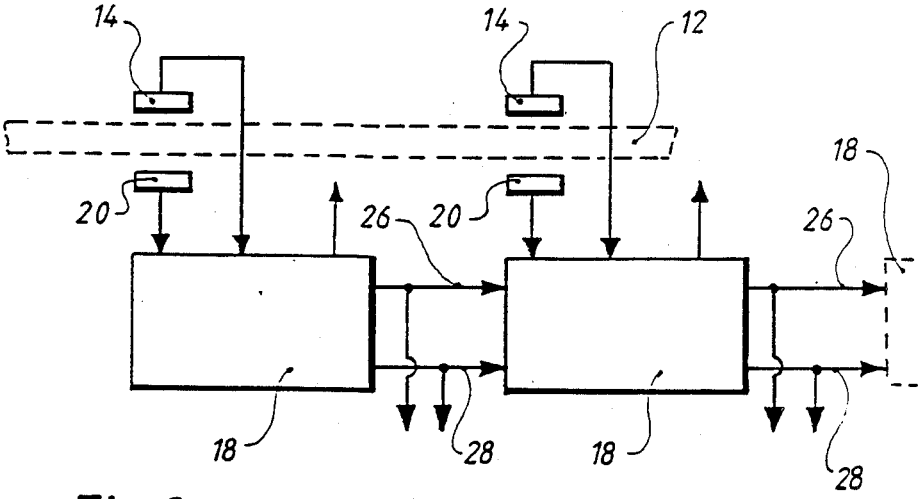
FIG. 9 is a schematic block diagram of the embodiment of FIG. 8 showing the inter-relationship between monitors.

FIG. 9 shows a schematic block diagram of the connections between the monitors 18, 18' respectively in the first multiple document detector set 10 and the second multiple document detector set 10'.

The first monitor 18, as well as providing a first signal output 26 indicative of the presence of multiple documents to the outside world, also provides the first signal output 26 as an input to the second monitor 18'. The second signal output 28 of the first monitor 18, as well as being provided to the outside world, is also provided as a signal input, indicative of completion of document separation, to the second monitor 18'. The second monitor 18' can in turn provide its first signal output 26' not only to the outside world but also as an input to a further monitor 18'' and can provide its second signal output 28', not only to the outside world, but also as a signal input to the third monitor 18''. It is contemplated that as many multiple document detector sets can be provided along the length of the track 12 as are necessary to transport documents 32, 34 along the entire length of the track.

Figure 10:
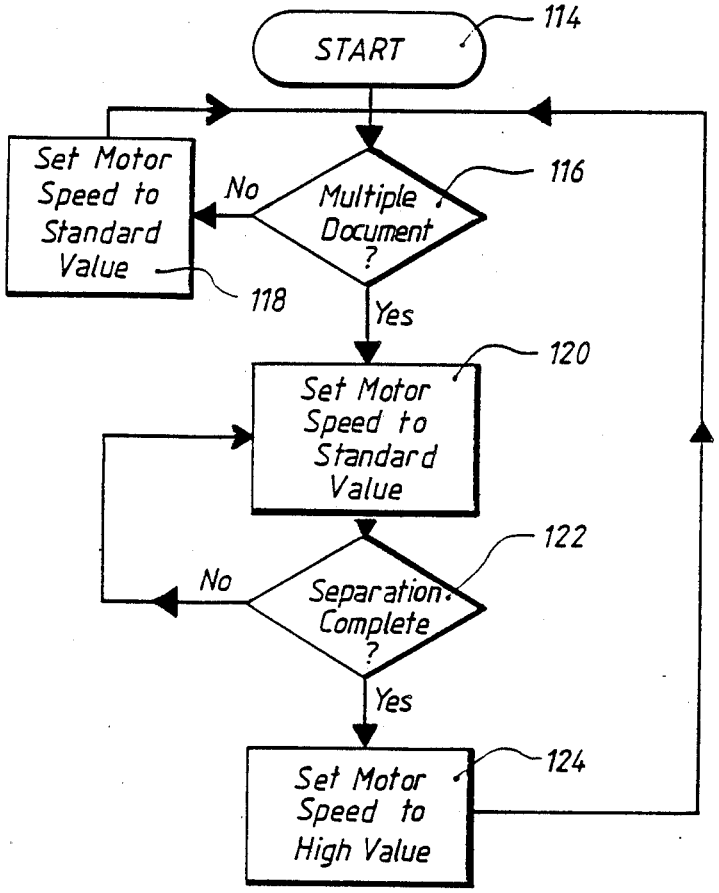
FIG. 10 is a flow chart illustrating the behaviour of the monitors in FIG. 9.

FIG. 10 is a flow chart showing the actions of each monitor 18, 18', 18'' in FIG. 9. The operation is entered from a start operation 114 when the equipment is first switched on. Control is passed immediately to a test 116 which checks to see if the preceding monitor (i.e. Item 18 is the preceding monitor to Item 18' in FIG. 9, and likewise Item 18' is the preceding monitor to Item 18'') has provided its first signal output 26 indicative of multiple documents 32, 34 being present in the nip 46. If multiple documents are not present in the preceding nip 46, the second monitor 18' sets the velocity of the motor 48 in a third operation 118 to a standard value which is the same as the motor velocity for the motor driving the preceding driven wheel 42. Control is then passed back to the test 116. If the test 116 detects output 26 from the preceding monitor 18 indicative of multiple documents being present in the nip 46 of the first, feeding multiple document detector set 10, control is passed to operation 120 where the speed of motor 48 in the second multiple document detector set 10' is set to the same standard value. Thus, as the two documents 32, 34 are separated with one of the documents 34 gripped in both nips 46, 46', the document 34 passing through both nips 46, 46' is driven at the same speed by both nips 46, 46'.

The operation 120 passes control to test 122 which tests to see if the first or feeding controller 18 has provided the second signal output 28 indicative of document separation having been completed. If document separation is not complete, control is passed back to the operation 120. If document separation is complete control is passed to operation 124 where the controller 18' in the second multiple document detector set 10 sets the velocity of the motor 48 in the second multiple document detector set 10' to a higher value which momentarily causes the document 34 which has been separated from another document 32 to be accelerated along the track 12 to create a linear separation along the track 12 between it 34 and the following document 32. In this manner separated documents 32, 34 are spaced along the track 12.

In those instances where a separated document 34 encounters subsequent nips 46 wherein a documents is already present, the system simply adopts procedures once again to separate documents. Thus, if more than two documents are presented in the first nip 46, a plural string of multiple document detector sets 10 will separate the documents despite there being less distance between the nips 46, 46' than the length of a document 34.

The subsequent document detector set 10' can be replaced by a simple speed control acting in the manner of FIG. 10 as simple, further document moving means, still achieving linear document separation.

The motor 48 can be an ordinary electric motor driven at a controlled speed, in which instance the monitor 18 provides a signal determining the speed of the motor 48. The multiple document detector set 10 may comprise more than simply a driven wheel 42 and an idler wheel 44. For example, the driven wheel 42 and the idler wheel 44 may be accompanied by one or more traction belts and other items.

It is to be understood hereinbefore and hereinafter that, when reference is made to a driven wheel as the driven member 42 or to an idler wheel 44 as an idler member, reference is also included to systems including document transport belts, drive belts and the like. It is simply necessary in the present invention that the idler member provide a movement opposing drag and that separation by mutual sliding between documents can take place. The present invention also provides for an idler wheel to be urged against a driven belt, or for a driven wheel to be urged against a retarded belt, or for two belts to come together to form a document separating nip.

The present invention further provides that the monitor 18 18' is functional to monitor the peripheral velocities of the idler member or wheel and of the driven member or wheel to measure the linear velocities of documents along the track.

I claim:

1. An apparatus for detecting simultaneous presentation of multiple documents and for separating said documents comprising:

a first document detector set including document moving means having a driven member for imparting motive force to a document; an idler member, opposed to said driven member and co-operative with said driven member to grip documents therebetween; and a velocity monitor, said monitor monitoring relative peripheral velocity between said driven member and said idler member and providing a first output indicative of presentation of multiple documents when there is a difference between said relative peripheral velocities, said driven member being operative to continue to provide said motive force after provision of said first output by said velocity monitor in order to cause separation between multiple presented documents, said velocity monitor being operative to provide a second output indicative of completion of document separation when next said peripheral velocity of said driven member is equal to said peripheral velocity of said idler member, further document moving means coupled to said velocity monitor for receiving said first and second output, said further document moving means receiving said document from between said driven member and said idler member and being responsive to said second output for moving said document with an increased linear velocity greater than said peripheral velocity of said driven member, said further document moving means being inhibited from removing a document from between said driven member and said idler member with said increased velocity until said velocity monitor provides said second output.

2. An apparatus according to claim 1 wherein said driven member is driven by a stepping motor; wherein said idler member has an idler member encoder operative to provide a predetermined number of idler member output pulses for each revolution of said idler member; and wherein said velocity monitor compares the number of idler member output pulses with the number of steps executed by said stepping motor.

3. An apparatus according to claim 2 wherein said idler member encoder comprises an angular velocity transducer including a photodetector and associated optical disc.

4. An apparatus according to claim 1, wherein said driven member has a driven member encoder, operative to provide a predetermined number of driven member pulses for each revolution of said driven member; wherein said idler member has an idler member encoder, operative to provide a predetermined number of idler member output pulses for each revolution of said idler member; and wherein said velocity monitor is operative to compare the number of driven member output pulses with the number of idler member output pulses.

5. An apparatus according to claim 4 wherein said driven member encoder and said idler member encoder each comprises an angular velocity transducer including a photodetector and associated optical disc.

6. An apparatus according to claim 1 wherein said further document moving means comprises a second multiple document detector set.

7. An apparatus according to claim 6 wherein the driven member in said second set is a stepping motor activated such that the driven member in said first set and the driven member in said second set have equal peripheral velocities until said velocity monitor in said first set provides said second output.

8. An apparatus according to claim 1 wherein said velocity monitor is operative to monitor the linear velocity of a document.

9. An apparatus according to claim 1 wherein said driven member comprises a driven wheel.

10. An apparatus according to claim 1 wherein said idler member comprises an idler wheel and wherein said document movement opposing force is a rotation opposing torque.

11. An apparatus according to claim 1 wherein the respective coefficients of said driven member and said idler member are greater than the coefficient of friction between adjacent surfaces of multiple documents, the respective peripheral velocities of said driven member and said idler member being substantially the same when a single document is disposed between the members, said idler member providing a document movement opposing force sufficient to cause a sliding action between adjacent documents disposed between the members, said sliding action resulting in a difference in the respective peripheral velocities of said driven member and said idler member.

12. An apparatus according to claim 11 wherein said idler member has a slipping clutch, operative to provide said document movement opposing force.

* * * * *